US006206303B1

(12) United States Patent
Shinozaki et al.

(10) Patent No.: US 6,206,303 B1
(45) Date of Patent: Mar. 27, 2001

(54) MANUALLY OPERATED SPRAY DEVICE FOR LIQUID

(75) Inventors: Natsuo Shinozaki; Katsuhito Kuwahara, both of Tokyo; Risa Iwata; Masami Chiku, both of Yokohama, all of (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 09/284,008

(22) PCT Filed: Aug. 12, 1998

(86) PCT No.: PCT/JP98/03606

§ 371 Date: Apr. 5, 1999

§ 102(e) Date: Apr. 5, 1999

(87) PCT Pub. No.: WO99/08800

PCT Pub. Date: Feb. 25, 1999

(30) Foreign Application Priority Data

| | | |
|---|---|---|
| Aug. 13, 1997 | (JP) | 9-233366 |
| Dec. 26, 1997 | (JP) | 9-369081 |
| Mar. 24, 1998 | (JP) | 10-096711 |
| Mar. 24, 1998 | (JP) | 10-096712 |

(51) Int. Cl.[7] ..... B05B 9/043

(52) U.S. Cl. ..... 239/333; 239/337; 222/321.2

(58) Field of Search ..... 239/310, 311, 239/333, 337, 340, 349, 364, 368, 369, 371, 407, 417.5, 433, 434, 569, 570, 571; 222/321.2, 321.7, 321.9, 518

(56) References Cited

U.S. PATENT DOCUMENTS

| | | | | |
|---|---|---|---|---|
| 5,110,052 | * | 5/1992 | Graf et al. | 239/333 |
| 5,147,087 | * | 9/1992 | Fuchs | 239/333 |
| 5,358,149 | * | 10/1994 | O'Neill | 222/321.2 |
| 5,628,461 | * | 5/1997 | Foster et al. | 239/333 |

FOREIGN PATENT DOCUMENTS

| | | |
|---|---|---|
| 2-504007 | 11/1990 | (JP) . |
| 7-300150 | 11/1995 | (JP) . |
| 9-118352 | 5/1997 | (JP) . |

* cited by examiner

*Primary Examiner*—Andres Kashnikow
*Assistant Examiner*—Lisa Ann Douglas
(74) *Attorney, Agent, or Firm*—Oliff & Berridge, PLC

(57) ABSTRACT

A manually operated spray device for spraying a liquid in a vessel comprises a cylinder member which includes an upper air cylinder and a lower liquid cylinder, an air piston slidably fitted in the air cylinder, and a suction pipe connected to the liquid cylinder within the vessel toward the bottom thereof. An actuator member is urged upwards and vertically movable relative to the cylinder member; and includes a hollow stem protruding upwards from the liquid cylinder and fitted at its center portion with the air piston, a press head fitted onto the upper portion of the stem, a nozzle hole opening at the side surface of the press head, and first and second passages merging with each other on the upstream side of the nozzle hole. The first passage is communicated with the air chamber on one side of the air piston, and the second passage is communicated with the liquid cylinder through the interior of the stem. By depressing the actuator member and displacing the air piston within the air cylinder, the air in the air chamber is ejected from the nozzle hole while a vacuum pressure is applied to the interior of the second passage so that the liquid in the vessel is sprayed from the nozzle hole as a mixture with the ejected air.

12 Claims, 14 Drawing Sheets

36
44
24
26
37
38
43
42
46
2
27
33
27a
34
1
30
8
21
45
52
22
6
10
11

MANUALLY OPERATED SPRAY DEVICE FOR LIQUID

TECHNICAL FIELD

The present invention relates to a manually operated spray device to be secured to an opening at an upper end of a vessel, for spraying a liquid which is contained in the vessel.

BACKGROUND ART

For spraying a liquid within a vessel, heretofore, small-sized, manually operated spray devices have been widely used. Conventional spray device is typically arranged such that the liquid within the vessel is pressurized by an appropriate pressurizing means and discharged from a nozzle hole. In this case, it is a customary practice to provide a spinning mechanism within a nozzle hole, for rotating the liquid at high speed so that the liquid rotating at high speed is discharged from the nozzle hole and atomized as the discharged liquid comes into contact with ambient air. With such spray device, particularly when the liquid to be sprayed is a high viscosity liquid, such as oil, there may be instances wherein the atomization becomes unstable or even impossible as the case may be. Thus, there is need for a manually operated spray device which is capable of achieving a more positive and stable atomization, regardless of the type or physical property of the liquid to be sprayed.

DISCLOSURE OF THE INVENTION

It is therefore a primary object of the present invention to provide a manually operated spray device which satisfies the above-mentioned need and which can be easily produced at a low cost.

To this end, according to the present invention, there is provided a manually operated spray device to be secured to an opening at an upper end of a vessel, for spraying a liquid contained in the vessel, comprising: a cylinder member including an upper air cylinder, a lower liquid cylinder, an air piston slidably fitted in said air cylinder, and suction pipe connected to said liquid cylinder and suspended within the vessel toward a bottom of the vessel; and an actuator member protruding upwards from the cylinder member and arranged so as to be urged upwards and vertically movable relative to the cylinder member. The actuator member includes a hollow stem having an intermediate portion where it is connected to the air piston, a press head fitted onto an upper portion of the stem, a nozzle hole opening at a side surface of the press head, and first and second passages merging with each other on an upstream side of the nozzle hole. The first passage is in communication with an air chamber on one side of the air piston, and the second passage is in communication with the liquid cylinder through inside of the stem. These passages are so arranged that air within the air chamber is discharged from the nozzle hole, through the first passage, by depressing the actuator member toward the vessel, thereby applying a vacuum within inside of the second passage such that the liquid within the vessel is mixed with air and discharged from the nozzle hole.

With the above-mentioned structure of the liquid spray device according to the present invention, when the actuator member is depressed to cause a downward displacement of the air piston, the air within the air chamber is discharged from the nozzle hole via the air passage, and the liquid within the vessel is positively sucked by the air discharged from the nozzle hole at a high speed, under the application of Bernoulli's theorem, and discharged with the air as mist. It is therefore possible to readily and positively atomize a liquid by increasing the air discharge pressure, even when the liquid is one for which atomization had been considered difficult in the past.

For carrying out the present invention, it is advantageous that the actuator member includes a transverse bore within the press head, which extends in a radial direction substantially in alignment with the nozzle hole, and an inner tube arranged within the transverse bore, one of the first and second passages being formed by a passage which extends through inside of the inner tube of the nozzle hole, and the other of the first and second passages being formed by a passage which extends along an outer surface of the inner tube to the nozzle hole.

According to a preferred embodiment of the present invention, the press head of the actuator member includes a peripheral wall surrounding an upper portion of the stem, and the air piston has a boss in its center portion, wherein the boss is fitted onto an outer surface of the stem and has an outer surface at its upper portion, which is fitted, in a liquid-tight manner, with an inner surface of the peripheral wall at its lower portion, such that the boss can be moved vertically, relative to the peripheral wall, within a predetermined small stroke, and the first passage is partly formed of a clearance between the inner surfaces of the peripheral wall and the boss and the outer surface of the stem. The stem has an intermediate portion which is provided with a seat having an upper surface with which a lower end surface of the boss can be brought into contact, with the lower surface of the boss and the upper surface of the seat forming an air discharge valve.

In this instance, it is particularly preferred that the frictional resistance of the inner surface of the boss relative to the outer surface of the stem is made smaller than the frictional resistance of an outer surface of the air piston relative to the inner surface of the air cylinder. This is because, when the actuator member is depressed, the stem is caused to displace downwards earlier than the air cylinder to open the air discharge valve, and, upon upward displacement of the actuator member, the stem is caused to move upwards earlier than the air cylinder to close the air discharge valve, thereby ensuring a proper opening and closing operations of the air discharge valve.

In the above-mentioned embodiment of the present invention, it is preferred that the air piston comprises a wall having at least one valve hole between said boss and an outer peripheral portion thereof, which slidably contacts the inner surface of the air cylinder, and a seal means for nonnally shielding the valve hole from the air chamber and opening the valve hole relative to the air chamber when a negative pressure is applied to inside of the air chamber. This is because provision of such an ambient air suction valve in association with the air piston ensures that ambient air can be positively supplied into the air chamber.

The above-mentioned seal means may comprise an annular resilient sheet which is supported by the lower portion of the boss, wherein the resilient sheet has an outer periphery which can be brought into contact, in air-tight manner, with the lower surface of said wall at a location which is on the radially outer side of the valve hole.

The spray device according to the present invention may further comprise a liquid check valve which is arranged in the upper portion of the stem.

According to the present invention, furthermore, there may be arranged a spinning mechanism in the form of volute channels, at the downstream end of the first passage (air passage) where it merges with the second passage (liquid passage). In this instance, the mist being discharged from the nozzle is caused by the spinning mechanism to rotate at a high speed, to further promote atomization of the liquid.

As explained above, the liquid spray device according to the present invention makes it possible to readily and positively atomize a liquid by increasing the air discharge pressure, even when the liquid is one for which atomization had been considered difficult in the past. Nevertheless, it is preferred in accordance with the present invention to arrange a relief valve within the air passage, which opens when the pressure exceeds a predetermined level. Provision of such a relief valve serves to prevent fluctuation of spraying volume or spraying pattern due to variation of the depression force of the press head or the like, thereby making it possible to achieve a further improved spraying of the liquid within the vessel. The opening pressure of the relief valve can be appropriately determined depending upon the physical property, etc., of the liquid contained in the vessel, and can be readily adjusted.

In carrying out the present invention, in the event that a normally-closed type relief valve is disposed in the first passage, including a valve body which is resiliently urged toward a valve seat and opened when a predetermined pressure is reached, the resilient element for urging the valve body toward the valve seat may be arranged at an appropriate location either on the upstream side or the downstream side of the valve body. Alternatively, the valve body itself may be formed of a resilient material and arranged such that the valve body is urged toward the valve seat by the resiliency of the material itself.

BEST MODE FOR CARRYING OUT THE INVENTION

Figure 1:
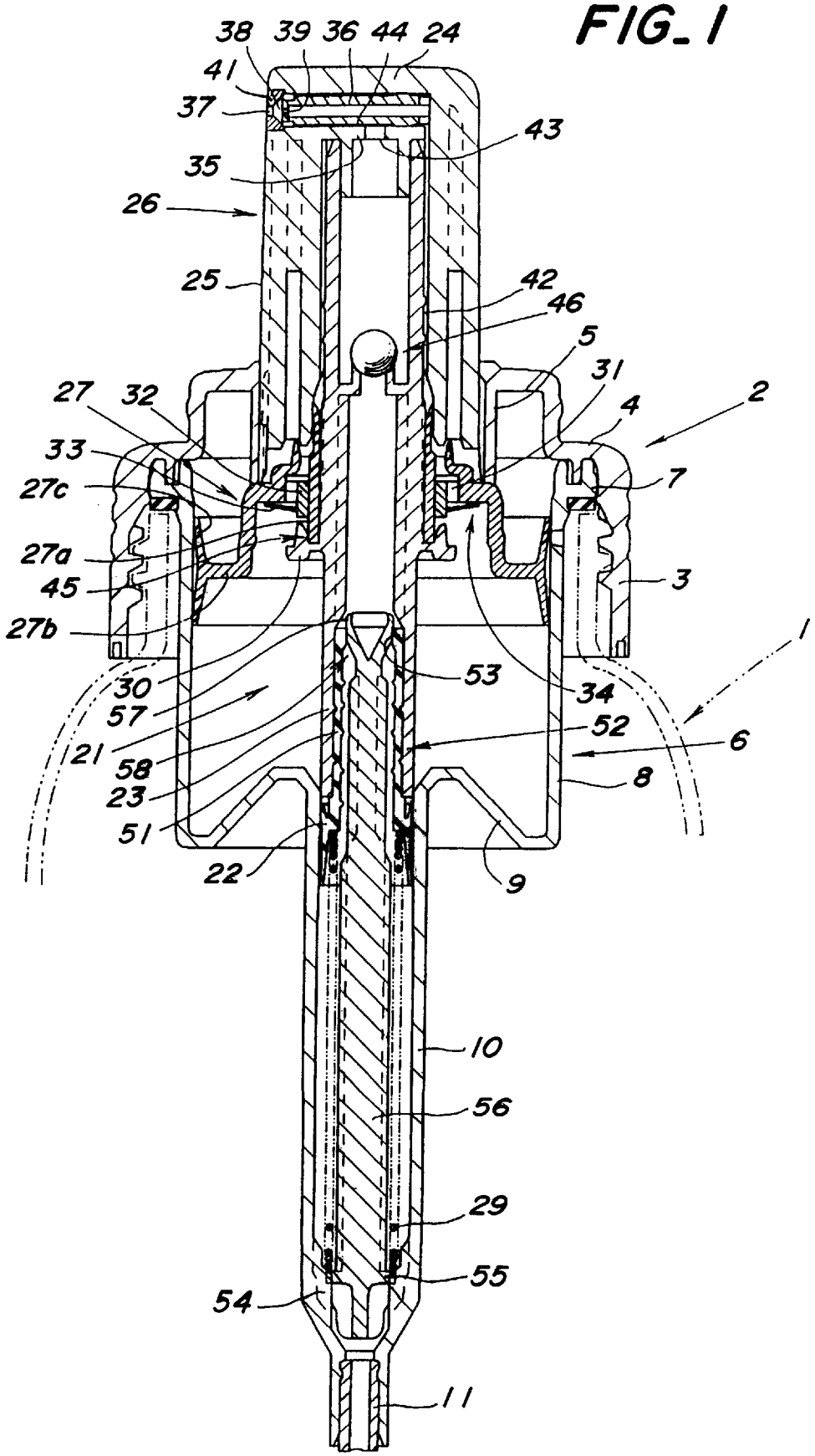
FIG. 1 is a longitudinal-sectional view showing the liquid spray device according to the first embodiment of the present invention.

The present invention will now be described in further details hereinafter, with reference to some preferred embodiments shown in the accompanying drawings. It is to be noted that, throughout the figures, same reference numerals are used to denote elements of substantially same structure or function.

As noted above, the present invention provides a manually operated liquid spray device which is secured to an opening at the upper end of a vessel, for spraying a liquid contained in the vessel by user's manual operation.

Figure 2:
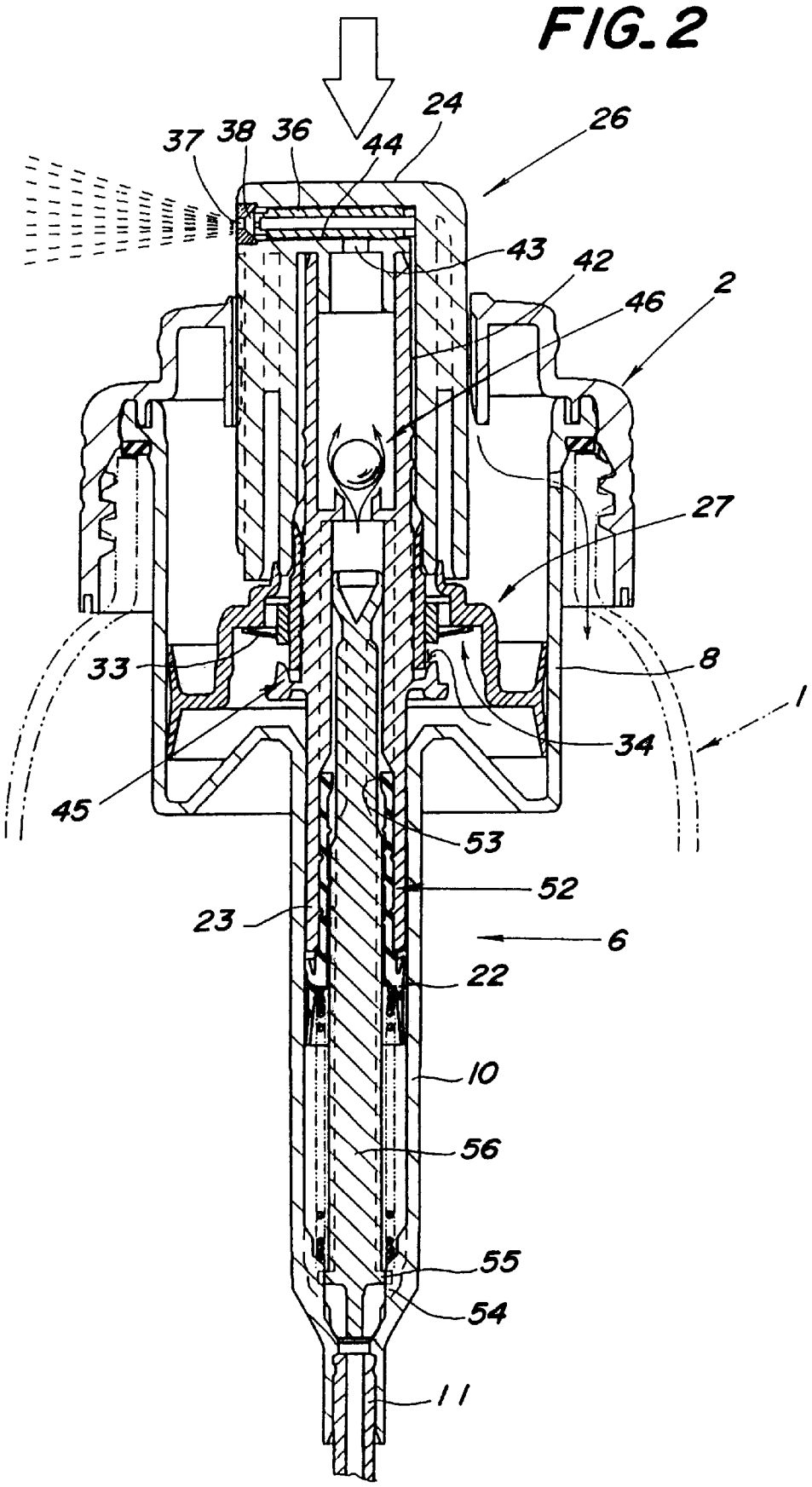
FIG. 2 is a longitudinal-sectional view showing the liquid spray device of FIG. 1, with the actuator member in a depressed state.
Figure 3:
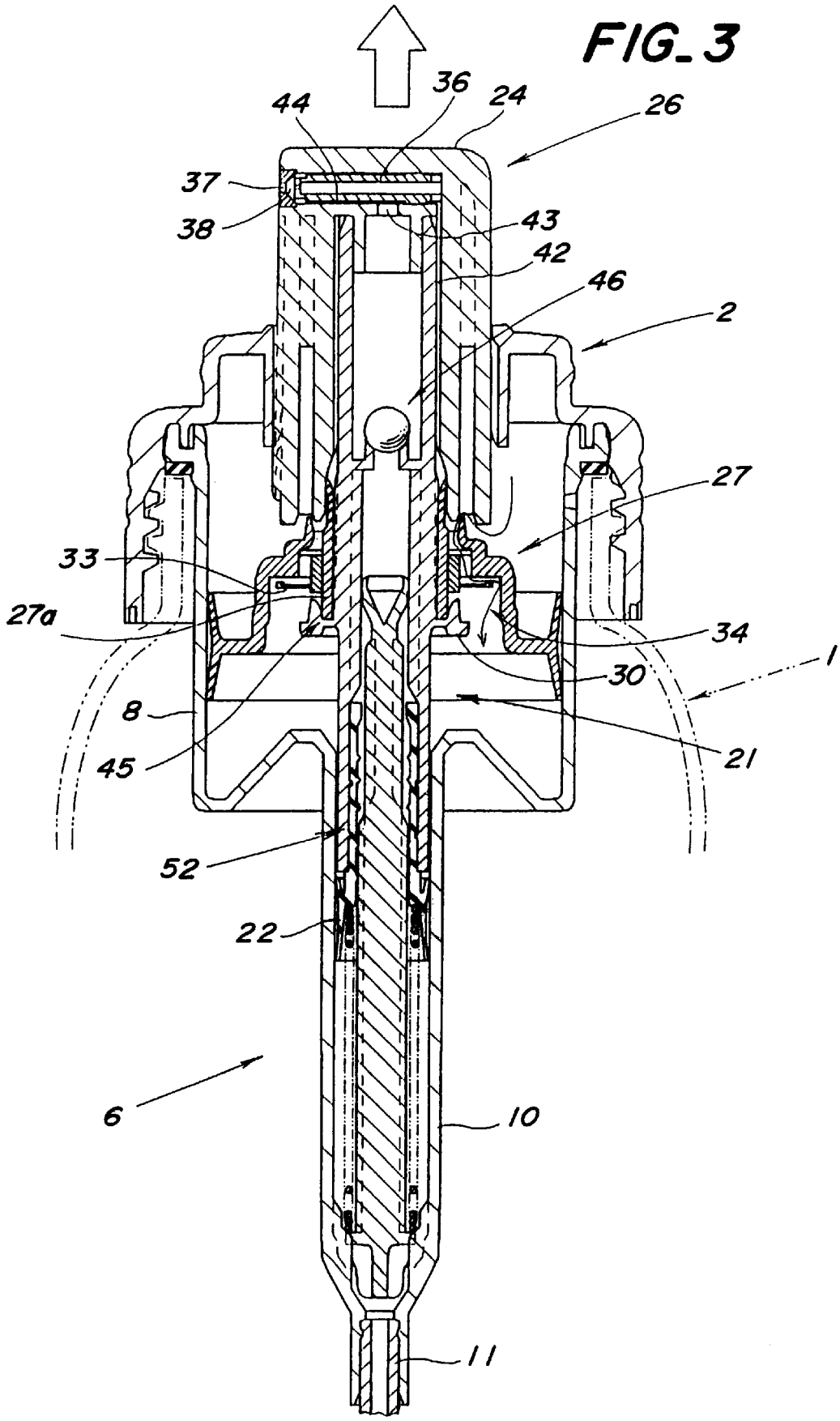
FIG. 3 is a longitudinal-sectional view showing the liquid spray device of FIG. 1, with the actuator member in a lifted state.

The first embodiment of the present invention is shown in FIGS. 1 to 3, in which only the upper portion of the vessel 1 is represented by imaginary line. The vessel 1 has an opening portion to which a threaded cap 2 is connected. The cap 2 has an outer peripheral wall 3 which is engaged with a threaded portion formed in the outer surface of the opening portion, and a top wall 4 connected to the upper end of the outer peripheral wall 3 to extend radially inwards, with a large center opening being formed in the top wall 4. The top wall 4 has a region adjacent to an inner peripheral wall 5, which is in the form of an upwardly protruding cylindrical projection. The inner peripheral wall 5 extends downwards, and forms a stopper for the air piston to be described hereinafter.

The spray device according to the present invention comprises a cylinder member 6, and an actuator member 21 protruding upwards from the cylinder member 6 and arranged so as to be urged upwards and vertically movable relative to the cylinder member 6. The structure of each of the cylinder member 6 and the actuator member 21 will be described below in further detail.

First of all, the cylinder member 6 has a flange 7 which is oriented radially outwards and clamped between the upper end surface of the opening portion of the vessel 1 and the top wall 4 of the cap 2, with a seal ring interposed therebetween. The cylinder member 6 has an air cylinder 8 of a relatively large diameter, which is arranged in the upper portion of the cylinder member. The air cylinder 8 has a lower surface 9 from which a liquid cylinder 10 of a relatively small diameter protrudes downwards. The liquid cylinder 10 has a lower end to which a suction pipe 11 is connected. The suction pipe 11 is suspended within the vessel 1, toward the vicinity of the bottom thereof.

In the next place, the actuator member 21 protruding upwards from the liquid cylinder 10 comprises a hollow stem 23 having a lower end provided with a seal piston 22 of a small diameter, which is slidably fitted and engaged with the inner peripheral surface of the liquid cylinder 10, as well as a press head 26 which is secured to the upper portion of the stem 23 so as to be manually operated by users.

The press head 26 may include a top wall 24, a double-cylindrical peripheral wall 25 protruding downwards from the periphery of the top wall 24, and a hollow cylindrical projection protruding downwards from the lower surface at the center of the top wall 24. This projection has an outer surface where the press head 26 may be fitted with the inner surface at the upper end portion of the stem 23. In this instance, it is preferred that a clearance is left between the inner peripheral surface of the peripheral wall 25 of the press head 26 and the outer peripheral surface of the stem 23 at the upper portion thereof, in order to form part of the air passage to be described hereinafter.

An air piston 27 which is large in diameter is slidably fitted within the air cylinder 8 so that air chamber is defined by the inner surface of the air cylinder 8 and the lower surface of the air piston 27. By way of example, the air piston 8 has a hollow cylindrical boss 27*a* in the center portion which is connected, via a flange-like intermediate portion 27*b*, with the outer peripheral portion 27*c* which, in turn, is in a sliding contact with the inner peripheral surface of the air cylinder 8. Furthermore, the boss 27*a* of the air piston 27 is fitted with the outer surface of the stem 23 at the intermediate portion thereof, so as to be vertically movable relative to each other, and the upper portion of the boss 27*a* is fitted with the inner surface at the lower portion of the peripheral wall 25 of the press head 26 in a liquid-tight manner, so that they are vertically movable relative to each other with a predetermined small stroke. In this instance, it is preferred that the frictional resistance between the intermediate portion of the stem 23 and the boss 27*a* is smaller than the frictional resistance between the inner peripheral surface of the air cylinder 8 and the outer peripheral portion 27*c* of the air piston 27.

A compression coil spring 29 is arranged within the liquid cylinder 10 below the stem 23, so that the stem 23 is urged upwards by the coil spring 29. By this, the upper surface at the intermediate region 27*b* of the air piston 27 is brought into pressure contact with the lower end surface of the inner peripheral wall 5 of the cap 2 and, at the same time, the upper surface of a seat 30 in the form of an annular collar on the outer surface of the intermediate portion of the stem 23 is brought into pressure contact with the lower end surface of the boss 27*a*.

In the illustrated embodiment, the intermediate portion 27*b* of the air piston 27 has a substantially cylindrical upstanding region which is arranged between annular peripheral regions on the outer and inner sides. A plurality of valve holes 31 are formed in the annular peripheral region on the inner side which is adjacent to the boss 27*a*, for allowing ambient air to be sucked therethrough. A synthetic resin sleeve 32 is fitted onto the outer surface at the lower portion of the boss 27 in air-tight manner, and an annular resilient sheet 33 is arranged to protrude radially outwards from the outer surface at the lower portion of the sleeve 32. In this instance, the outer periphery of the resilient sheet 33 is in contact with the lower surface of the intermediate portion 27*b* at location radially outwards beyond the valve holes 31, such that the valve holes 3 1 and the resilient sheet 33 form an ambient air suction valve 34. Incidentally, the ambient air suction valve 34 may have a structure other than what has been described above.

Figure 5:
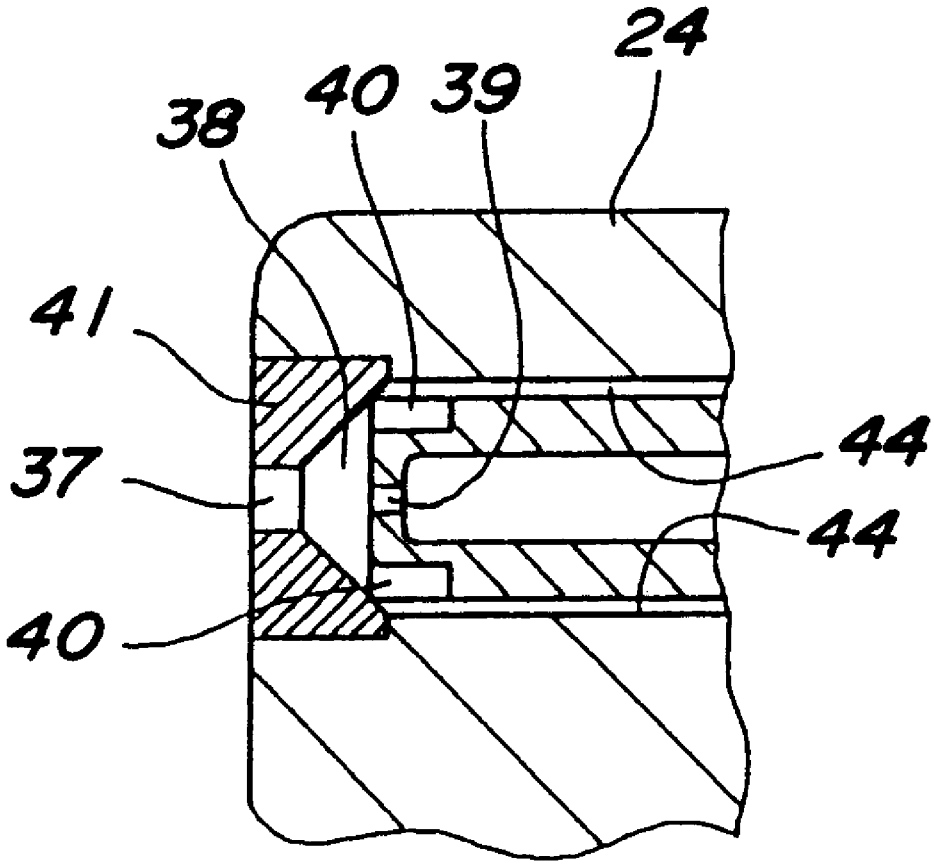
FIG. 5 is a sectional view, in enlarged scale, of the nozzle portion in the spray device of the first and second embodiments.

The top wall 24 of the press head 26 in the actuator member 21 is formed with a transverse bore which extends radially and is closed at its inner end, and an inner tube 36 is arranged in the transverse bore. As shown in FIG. 5, a nozzle hole 37 is formed in the side surface of the top wall in front of the inner tube 36, and a small clearance 38 is arranged between the nozzle hole 37 and the front end of the inner tube 36. The front end of the inner tube 36 is closed by an end wall, and a through hole 39 is formed in the center region of the end wall. The inner tube 36 has a rear end portion adjacent to the inner end of the transverse bore, which is formed with a plurality of cutouts communicating with the interior of the inner tube 36. On the other hand, a plurality of longitudinal grooves are formed along the outer surface of the inner tube 36, from its intermediate portion to the outer end thereof, and a plurality of recesses 40 are formed in the front end surface of the inner tube 36 for communicating these longitudinal grooves with the above-mentioned clearance 38. Also, a through hole 43 is formed in the lower portion 35 of the top wall 24 at a location between the transverse bore and the stem 23, for communicating the longitudinal grooves along the outer surface of the inner tube 36 with the interior of the stem 23.

In order to produce the press head 26 of such an arrangement in a reliable and facilitated manner, it is preferred that the above-mentioned nozzle hole 37 is formed in a nozzle plate 41 in advance, a transverse bore in which an inner tube 36 can be inserted is formed from the side surface of the top wall 24, an inner tube 36 is inserted and fitted into the transverse bore, and the nozzle plate 41 is subsequently fitted in the front end portion of the transverse bore such that it cannot be removed. The nozzle plate 41 has a rear surface which defines the clearance 38 and which is preferably tapered.

In the above-mentioned arrangement, an air passage 42 extends from the air chamber within the air cylinder 8 to the nozzle hole 37, and has a starting point at the lower end surface of the boss 27*a*. The air passage includes a clearance between the outer surface of the stem 23 and the inner surface of the boss 27*a*, a clearance between the outer surface of the stem 23 and the inner surface of the peripheral wall 25, the cutouts at the inner tube 36 and the interior of the inner tube 36, as well as the above-mentioned small clearance 38. Also, a liquid passage 44 extends from the liquid cylinder 10 to the nozzle hole 37, and includes the interior of the stem 23, the through hole 3 in the top wall portion 35, the longitudinal grooves along the outer surface of the inner tube 36, the recesses 40 and the above-mentioned small clearance 38. Incidentally, an air discharge valve 45 is formed by the lower end surface of the boss 27*a* at the air piston 27 and the upper surface of the seat 30. Also, a liquid check valve 46 is arranged in the stem 23 and includes a valve body in the form of a ball.

In the first embodiment illustrated in FIGS. 1–3, a small diameter seal piston 22 is independent from the stem 23. In this instance, the stem 23 has an inner surface at its lower portion, which is fitted with an inner cylindrical member 52. The inner cylindrical member 52 has a cylindrical portion 51 having a lower end which is formed as the seal piston 22.

The cylindrical portion 51 of the inner cylindrical member 52 has an inner surface at its upper end, which is provided with a valve seat in the form of a circumferential ridge 53. Also, a rod-like poppet 56 is loosely fitted in the liquid cylinder 10. The lower portion of the liquid cylinder 10 has an inner peripheral surface which is provided with a plurality of thin-walled projections 54. These projections 54 protrude radially inwards and extends in the longitudinal direction. The radially inner ends of the projections 54 at their intermediate regions as seen in the longitudinal direction are formed as steps to form a spring seat.

On the other hand, the poppet 56 has an outer peripheral surface at its lower portion, which is provided with an annular collar 55. The annular collar 55 has an outer periphery which is formed with a plurality of cutouts. These cutouts are engaged with the projections 54 in the liquid cylinder 10 such that the poppet 56 is guided so as to be vertically movable relative to the liquid cylinder 10, while being prevented from relative rotation therebetween. The upper portion of the poppet 56 extends through the inner cylindrical member 52, and terminates in an upper end region which is in the form of an enlarged head 57. The outer surface of the enlarged head 57 is arranged so that it can be brought into engagement, in a liquid-tight manner, with the upper surface of the ridge 53 at the upper end of the cylindrical portion 51. Thus, the ridge 53 at the cylindrical portion 51 of the inner cylindrical member 52 and the enlarged head 57 of the poppet 56 form a valve 58 for preventing leakage of the liquid.

Furthermore, the compression coil spring 29 for urging the actuator member 21 upwards, as mentioned above, is wound over the outer periphery of the poppet 56. The compression coil spring 29 has an upper end engaged with a downwardly directed surface of the inner cylindrical member 52 provided with the seal piston 22, as well as a lower end engaged with the spring seat 55 on the inner surface of the liquid cylinder 10. The compression coil spring 29 urges the actuator member 21 upwards, through the inner cylindrical member 52 and the stem 23. As a result, the poppet 56 in engagement with the ridge 53 at the upper end of the inner cylindrical member 52 is normally lifted to a position where the collar 55 contacts the lower end of the coil spring 29.

Figure 4:
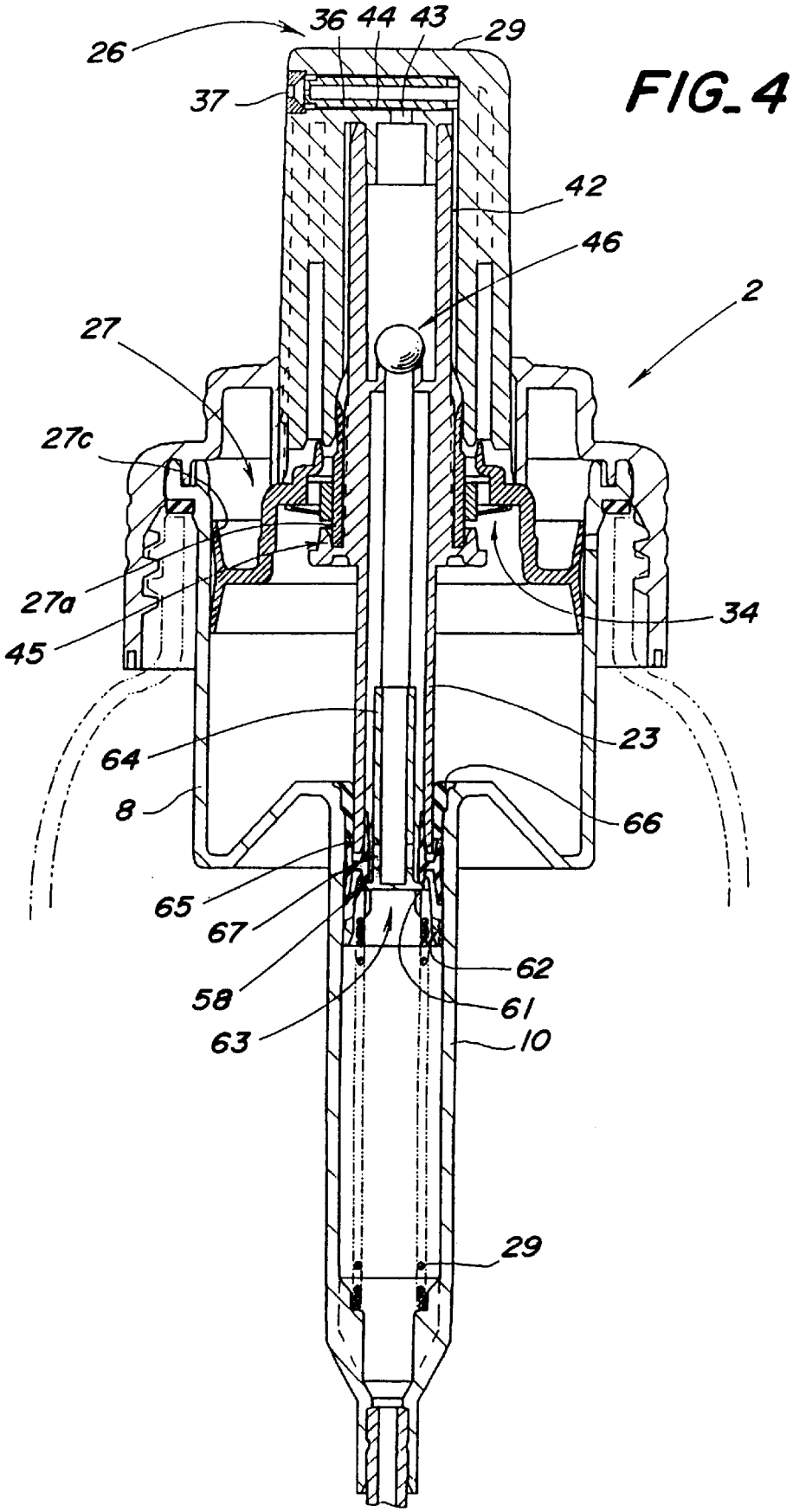
FIG. 4 is a longitudinal-sectional view showing the liquid spray device according to the second embodiment of the present invention.

In the second embodiment shown in FIG. 4, there is provided a small diameter seal piston 65 which slidably contacts the inner peripheral surface of the liquid cylinder 10, and which is formed independently from the stem 23. In this instance, an inner cylindrical member 63 having a cylindrical portion 64 for supporting the seal piston 65 at its lower end region is fitted in the stem 23 such that the lower end region is exposed.

The lower end region of the cylindrical portion 64 is formed with through holes 67 for allowing passage of the liquid, and the lower end is closed by a disc 61 in the form of a flange which is oriented outwards. The disc 61 has a lower surface provided with a substantially cylindrical projection which protrudes downwards. The outer peripheral surface of this projection supports a guide ring 62 so that it is maintained in sliding contact with the inner peripheral surface of the liquid cylinder 10. The inner peripheral surface of the projection is stepped to form a spring seat which is oriented downwards. The spring seat is engaged with the upper end of the compression coil spring 29 which is accommodated in the liquid cylinder 10 for urging the actuator member 21 upwards.

The lower portion of the stem 23 has an inner surface with an enlarged diameter, so as to support the seal piston 65 between the lower end of the stem 23 and the disc 61. The seal piston has a double-cylindrical shape having an outer peripheral portion and an inner peripheral portion which are connected to each other through a flange-like intermediate portion. The upper region of the inner cylindrical portion of the seal piston 65 is fitted into the lower portion of the stem 23 in a liquid-tight manner, and the lower end of the inner peripheral portion is mounted on the upper surface of the disc 61. The outer peripheral portion of the seal piston 65 is in sliding contact with the inner peripheral surface of the liquid cylinder 10 in liquid-tight manner, such that the seal piston is vertically movable by a small stroke, relative to the stem 23 and the inner cylindrical member 63. The inner surface at the upper end of the liquid cylinder 10 is fitted with a retainer 66 for preventing withdrawal of the outer peripheral portion of the seal piston 65. Incidentally, the lower end of the cylindrical portion 64 of the inner cylindrical member 63 and the upper surface of the disc 61 form a valve for preventing leakage of the liquid. In the aspects other than what has been described above, the second embodiment is essentially same as the first embodiment so that superfluous explanation will be omitted.

The operation of the above-mentioned embodiments will be described below, as follows:

At the outset, from the position shown in FIG. 1 or 4, the press head 26 of the actuator member 21 is continuously reciprocated in the vertical direction, so that the liquid within the vessel 1 is admitted into the liquid cylinder 10. In such a state, when the press head 26 is depressed as shown in FIG. 2, the stem 23 together with the press head 26 is moved downwards relative to the air piston 27 to open the air discharge valve 45. Subsequently, the lower end of the peripheral wall 25 of the press head 26 is brought into abutment with the upper surface of the air piston 27, and the air piston 27 is caused to move downwards, together with the stem 23, while maintaining the air discharge valve 45 in its open state. On this occasion, since the air suction valve 34 is in a closed state, the air within the air chamber is discharged from the nozzle hole 37, through the air passage 42 and the small clearance 38. In such instance, as can be clearly appreciated from Bernoulli's theorem, a negative pressure acts upon the outer peripheral region of the small clearance 38, which is applied also to the interior of the liquid passage 44 in communication with the small clearance 38. Therefore, the liquid within the liquid cylinder 10 is sucked into the small clearance 38, through the liquid passage 44, mixed with air to be ejected, and then ejected from the nozzle hole 37 as mist.

Incidentally, during the period in which air within the air chamber is ejected from the nozzle hole 37, the ambient air is introduced, as shown by arrows in FIG. 2, into the upper space of the air cylinder 8 between the inner peripheral wall 5 of the cap 2 and the outer peripheral surface of the press head 26, and further into the vessel via through hole formed in the inner peripheral wall of the air cylinder 8. This through hole is opened when the air piston 27 is moved downwards together with the stem 23.

In the next place, when the press head 26 is released, the ejection of air is stopped so that the negative pressure state in the small clearance 38 disappears, resulting in the closure of the liquid check valve 46. On this occasion, the stem 23 moves upwards earlier than the air piston 27, to close the air discharge valve 45. This is due to the fact that the frictional resistance between the intermediate portion of the stem 23 and the boss 27*a* is smaller than the frictional resistance between the air cylinder 8 and the outer peripheral portion 27*c* of the air piston 27. The air piston 27 is subsequently lifted through the seat 30, so that the interior of the air chamber is applied with negative pressure, resulting in that the ambient air suction valve 34 is opened and ambient air is sucked into the air chamber.

In the embodiment shown in FIGS. 1–3, when the actuator member 21 is lifted to its upper limit position, the liquid leakage preventing valve 58 is closed, which is formed by the outer surface at the enlarged head 57 of the poppet 56 and the ridge 53 at the upper end of the cylindrical portion 52. Furthermore, in the embodiment shown in FIG. 4, when the actuator member 21 is lifted to its upper limit position, the liquid leakage preventing valve 58 is closed, which is formed by the upper surface of the disc 61 at the lower end of the cylindrical portion 64 of the inner cylindrical member 63 and the lower end surface of the inner peripheral portion of the seal piston 65. As a result, for instance, even when the vessel falls sideways, the liquid within the liquid cylinder 10 is prevented from leakage into the stem 23.

In the above-mentioned embodiments, the mist is ejected in a substantially straight manner, from the nozzle hole 37 at the side surface of the press head 26. However, it is possible to provide known spinning mechanism in association with the nozzle hole 37 so that mist is ejected while it is rotated at a high speed, in order to further promote the atomization.

Figure 6:
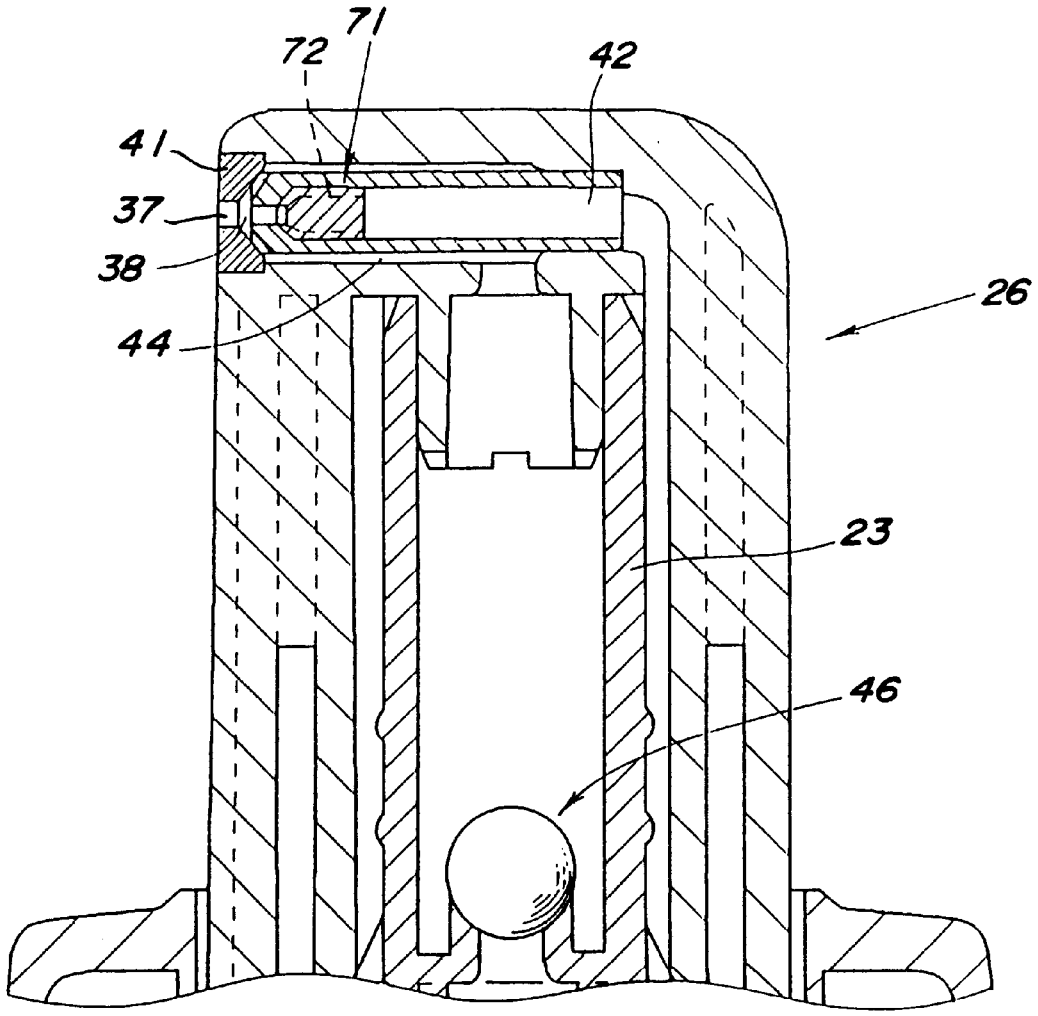
FIG. 6 is a sectional view, in enlarged scale, showing a portion of the actuator member in the liquid spray device according to the third embodiment of the present invention.
Figure 7:
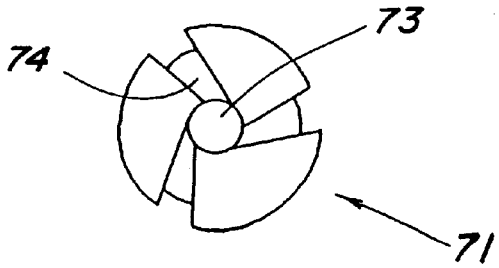
FIG. 7 is a front view, in enlarged scale, of the volute channel member used in the spray device of FIG. 6.

In this instance, as shown in FIG. 6, a spinning tip 71 may be fitted into the front end portion of the inner tube 36. The tip 71 is in the form of a rod which can be fitted into the front end portion of the transverse bore for accommodating the inner tube 36 therein. The tip 71 has an outer peripheral surface formed with a plurality of longitudinal grooves 72 which extend from the front end to the rear end. As shown in FIG. 7, the front end surface of the tip 71 is formed with volute channels 74 which extend from the front ends of the above-mentioned longitudinal grooves 72 to the side wall of a circular recess 73 at the center of the front end surface. In order that the liquid introduced into the circular recess 73 through the longitudinal grooves 72 and the volute channels 74 is rotated in the same direction along the side wall of the circular recess 73, the inner end of each volute channel 74 opens into the circular recess 73 at a location which is offset relative to the center of the circular recess 73 with a predetermined eccentricity. Alternatively, the longitudinal grooves 72 and the volute channels 74 may be provided for the inner surface of the inner tube 36. In this instance, the longitudinal grooves 72 are provided on the inner peripheral surface of the inner tube 36, and the volute channels 74 are provided on the inner surface of the closure wall at the front end of the inner tube 36. Also, the volute channels 74 may be provided on the inner surface of the nozzle plate 41.

Figure 8:
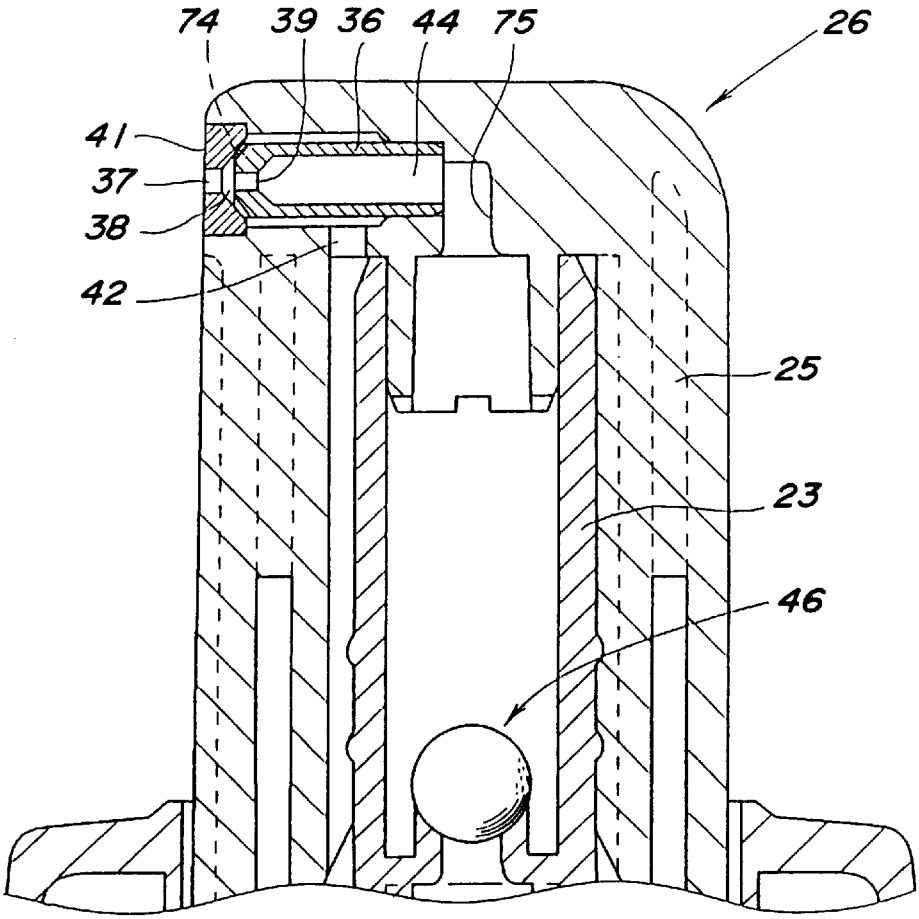
FIG. 8 is a sectional view, in enlarged scale, showing a portion of the actuator member in the liquid spray device according to the fourth embodiment of the present invention.
Figure 9:
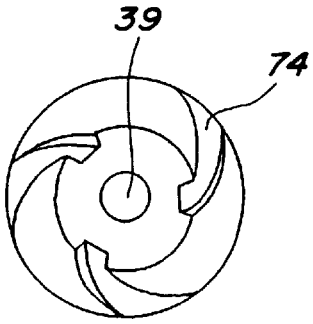
FIG. 9 is a front view, in enlarged scale, of the volute channel member used in the spray device of FIG. 8.
Figure 10:
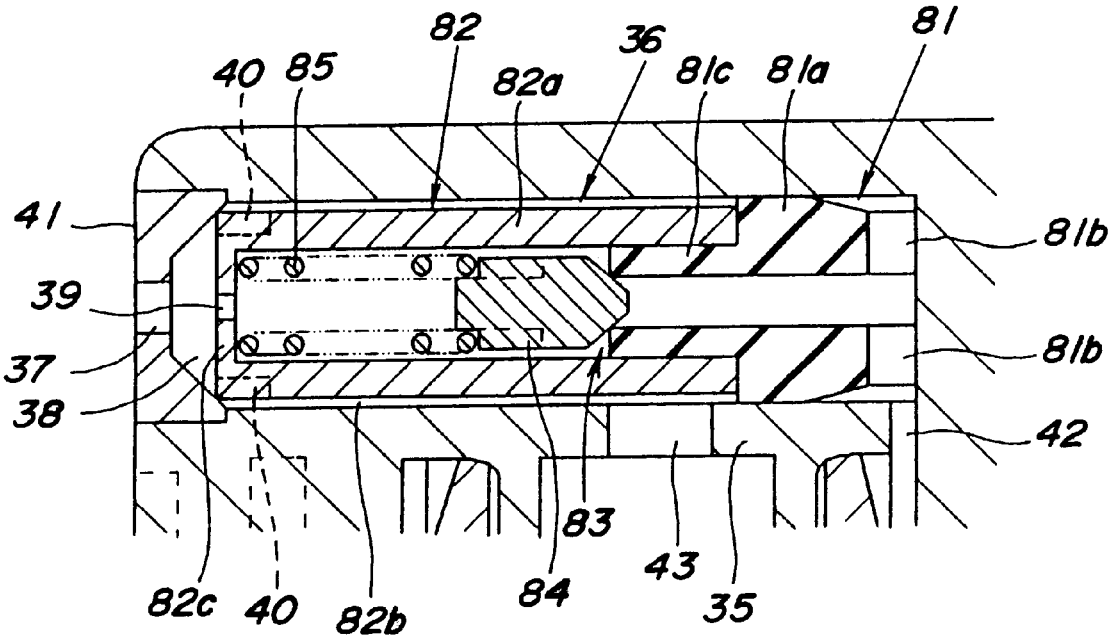
FIG. 10 is a sectional view, in enlarged scale, showing one variation applicable to each embodiment of the present invention, in which a relief valve is disposed in the air passage within the ejector tube.
Figure 11:
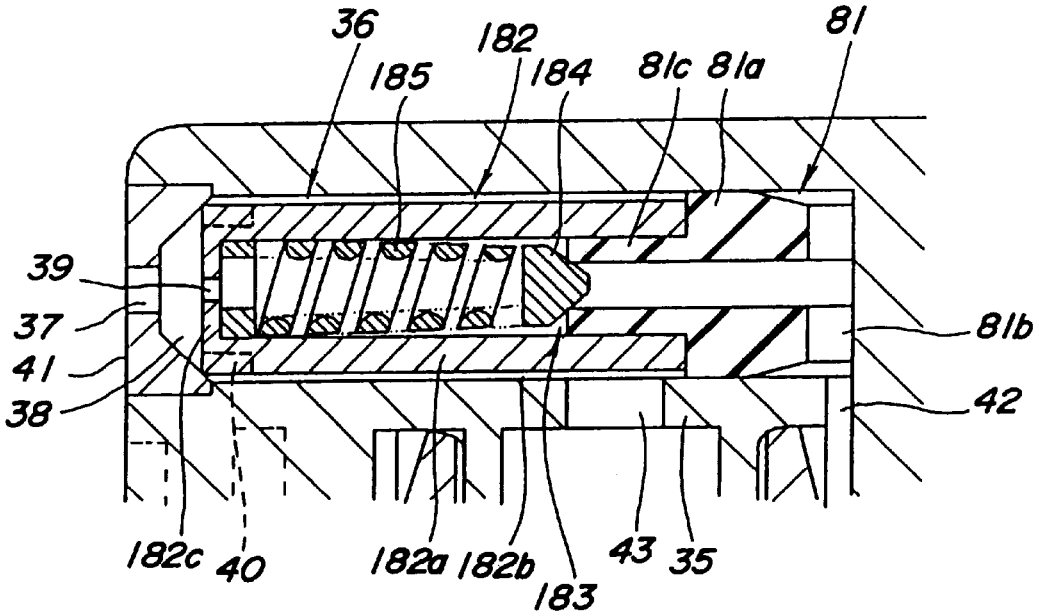
FIGS. 11 to 21 are sectional views, in enlarged scale, showing further variations of the relief valve disposed in the air passage within the ejector tube.

In the embodiment shown in FIGS. 8 and 9, the interior of the inner tube 36 forms part of the liquid passage 44, and the grooves on the outer side of the inner tube 36 form part of the air passage 42. In this instance, the transverse bore for fitting the inner tube 36 is shortened and the rear end of the inner tube 36 is communicated with a vertical bore 75 which is formed in the lower portion of the top plate 24 and enclosed by a cylindrical fitting which, in turn, is suspended from the lower surface of the top plate 24 and fitted into the upper portion of the stem 23, such that the vertical bore 75 and the interior of the inner tube 36 form the liquid passage 44. Furthermore, as for the air passage 42, the front end of the clearance between the outer surface at the upper portion of the stem 23 and the inner surface of the peripheral wall is opened in the bottom wall of the transverse bore such that the clearance and the grooves on the outer surface of the inner tube form the air passage 42. Incidentally, in the present embodiment, the above-mentioned spinning mechanism in the form of the volute channels 74 are formed in the front surface of the end plate which closes the front end of the inner tube 36 and which is formed with a through hole 39. Alternatively, however, it is possible to form the volute channels 74 in the inner surface of the nozzle plate 41 which is provided with the nozzle hole 37.

The liquid spray device according to the present invention having a structure as explained above makes it possible to readily and positively atomize the liquid by increasing the air discharge pressure, even when the liquid is one for which atomization had been considered difficult in the past. Nevertheless, it is preferred in accordance with the present invention to arrange a relief valve within the air passage 42, in particular within the inner tube 36, which opens when the pressure exceeds a predetermined level. Provision of such a relief valve serves to prevent fluctuation of spraying volume or spraying pattern due to variation of the depression force of the press head 26 or the like, thereby making it possible to achieve a further improved spraying of the liquid within the vessel. The opening pressure of the relief valve can be appropriately determined depending upon the physical property, etc., of the liquid contained in the vessel, and can be readily adjusted by the intensity of the spring, weight or shape of the valve body, etc., to be explained hereinafter. Also, the inner tube and the relief valve of various configurations may be adopted.

In the embodiments shown in FIGS. 10–19, the inner tube 36 is inserted and fitted into the transverse bore from the front side, which extends inwards from the side surface at the upper portion of the press head 26. The inner tube 36 is composed of a first tubular member 81 and a second tubular member 82 which are fitted to each other, so as to facilitate the assembly of a relief valve 83. The transverse bore has an inner wall formed with a through hole 43 which is communicated with the interior of the stem 23 to form part of the liquid passage 44. Furthermore, the transverse bore has a rear end portion formed with a through hole which is communicated with the clearance between the inner surface of the peripheral wall 25 of the press head 26 and the outer peripheral surface of the stem 23 to form part of the air passage 42. The transverse bore has a front end portion into which the nozzle plate 41 having a nozzle hole 37 at its center is fitted such that it cannot be removed. The nozzle plate 41 has a rear surface which defines the clearance 38 and formed as a dish-like tapered surface.

In the embodiments shown in FIGS. 10–14, the first tubular member 81 has a large diameter portion 81 a with an increased outer diameter, which is tightly fitted with the inner periphery at the rear portion of the transverse bore. The large diameter portion 81 a has a rear end formed with a cutout which extends forwards so as to communicate the interior of the large diameter portion with the interior of the air cylinder 8. A small diameter portion 81*c* protrudes forwardly from the front end of the large diameter portion 81 a. The second tubular member 82, 182, 282, 382, 482 has a cylindrical portion 82*a*, 182*a*, 282*a*, 382*a*, 482*a* of which the rear region is tightly fitted over the small diameter portion of the first tubular member 81, and an outer peripheral surface defining clearances 82*b*, 182*b*, 282*b*, 382*b*, 482*b*, which are communicated with the interior of the stem 23. The cylindrical portion 82*a*, 182*a*, 282*a*, 382*a*, 482*a* has a front end closed by an end wall 82*c*, 182*c*, 282*c*, 382*c*, 482*c* which is formed with a through hole 39 at the center thereof. The front end of the cylindrical portion 82*a*, 182*a*, 282*a*, 382*a*, 482*a* is brought into abutment with the tapered surface at the rear side of the nozzle plate 41, so as to define the small clearance 38 between the nozzle hole 37 and the front end of the inner tube 36. The end wall 82*c*, 182*c*, 282*c*, 382*c*, 482*c* of the cylindrical portion 82, 182, 282, 382, 482 has an outer periphery which is formed with a plurality of circumferential recesses 40, such that the clearances 82*b*, 182*b*, 282*b*, 382*b*, 482*b* are communicated with the small clearance 38 by the recesses 40. The relief valve 83, 183, 283, 383, 483 comprises, for instance, a valve body 84, 184, 284, 384, 484 which is accommodated in the second tubular member 82, 182, 282, 382, 482 for closing, in air-tight manner, the front end opening of the small diameter portion 81*c* at the first tubular member 81, and a spring 85, 185, 285, 385, 485 for normally urging the valve body 84, 184, 284, 384, 484 rearwards, i.e., toward the first tubular member 81.

In the embodiment shown in FIG. 1, the relief valve 183 comprises a valve body 184 which is formed of resilient material as a whole and of which the end portion is formed into a frustoconical shape. The remainder of the valve body excluding the end portion is formed as an integral compression coil spring 185 having a free end which is engaged with the inner surface of the end wall 182*c* of the second tubular member 182 to urge the end portion of the valve body 184 rearwards.

Figure 12:
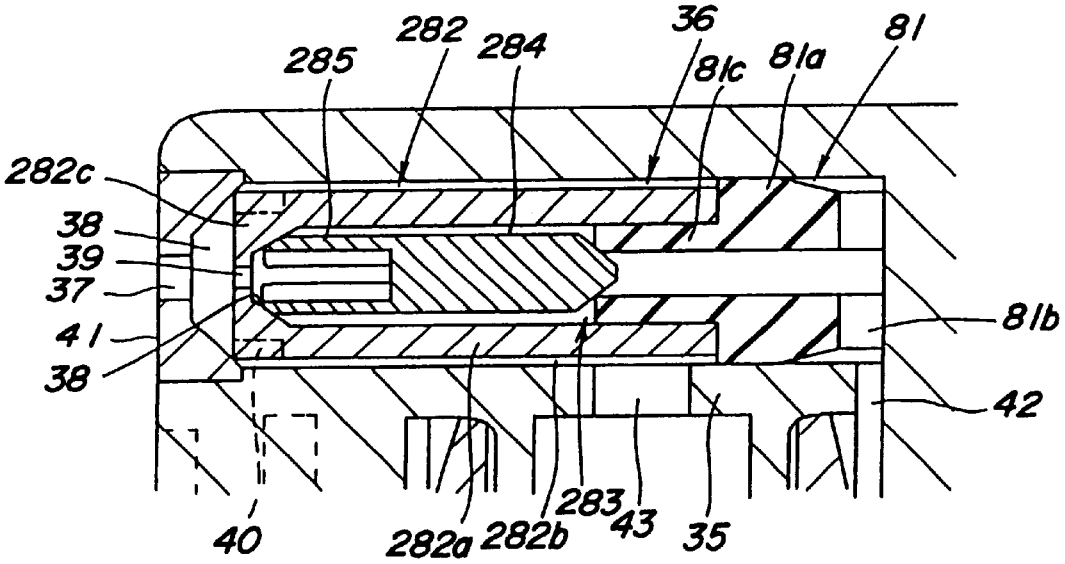

In the embodiment shown in FIG. 12, the relief valve 283 comprises a valve body 284 formed of resilient material as a whole, having an elongated barrel with an end portion of frustoconical shape. The valve body 284 has an end surface which is situated on the side of the end wall 282*c* of the second tubular member 282. This end surface has a peripheral region which is integrally provided with a plurality of resilient legs 285 of an arcuate cross-sectional shape. The free ends of these resilient legs 285 are resiliently urged against the tapered inner surface of the end wall 282*c* so as to urge the valve body 284 rearwards.

Figure 13:
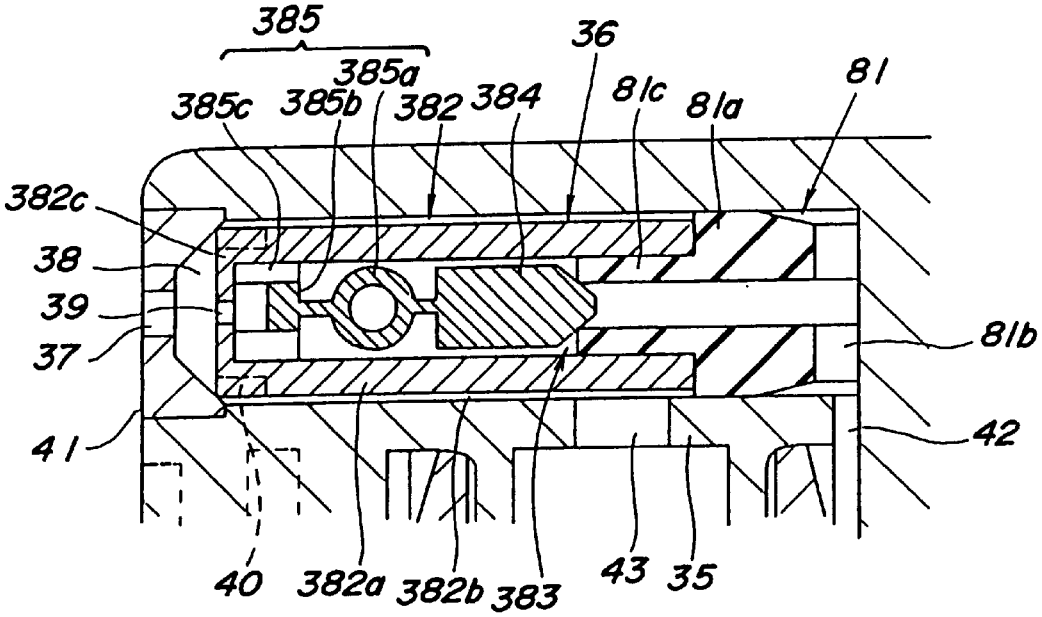

In the embodiment shown in FIG. 13 also, the relief valve 383 comprises a valve body 384 formed of resilient material as a whole, having an elongated barrel with an end portion of frustoconical shape. The valve body 384 is integrally provided with a resilient body 385 wherein a resiliently deformable ring 385*a* is arranged between front and rear rods. The resilient body 385 has a front end portion opposite to the end wall 382*c* of the second tubular member 382, which is formed as a cylindrical base portion 385*b* of an open shape, and an axial through hole 385*c* is formed in the base portion 385*b* and communicated with the through hole 39 in the end wall 382*c*. The resilient body 385 has a rear end which is integrally connected to the central region in the front surface of the valve body 384, so that the valve body 384 is urged rearwards by the resilient body 385.

Figure 14:
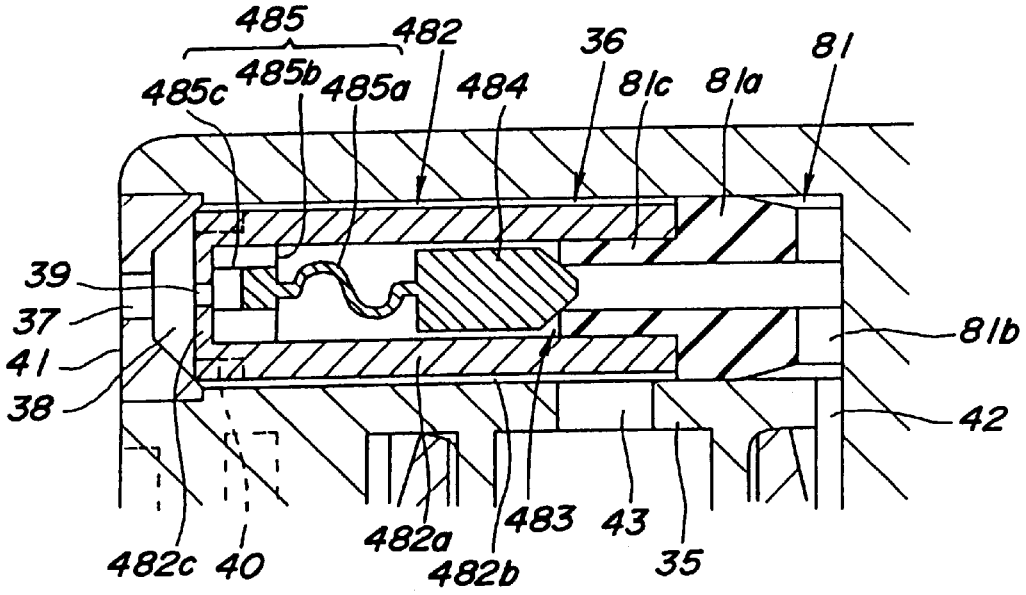

The embodiment shown in FIG. 14 is essentially same as the embodiment of FIG. 13, except that the resilient body 485 for urging the valve body 484 rearwards includes a resiliently deformable curved portion 485*a* arranged between front and rear rods.

In the embodiments shown in FIGS. 15–18, the valve body 584, 684, 784, 884 of the relief valve 583, 683, 783, 883 is in the form of a rod which extends from the interior of the large diameter portion 81*a* of the first tubular member 81, through the small diameter portion 81*c*, to the interior of the cylindrical portion 582*a*, 682*a*, 782*a*, 882*a* of the second tubular member 582, 382, 782, 882. The valve body 584, 684, 784, 884 has an end portion 584*a*, 684*a*, 784*a*, 884*a* with an increased diameter, which is arranged within the cylindrical portion 582*a*, 682*a*, 782*a*, 882*a* so that the peripheral region on the rear surface of the end portion 584*a*, 684*a*, 784*a*, 884*a* is urged against the peripheral region around an opening at the front end of the small diameter portion 81 c of the first tubular member 81, and the opening can be thereby closed in air-tight manner. The spring 585, 685, 785, 885 for urging the valve body 584, 684, 784, 884 rearwards is arranged within the large diameter portion 81 a of the first tubular member 81. The large diameter portion 81 a has an increased inner diameter, so that an annular shoulder portion 81*d* is formed at the junction with the small diameter portion 81*c* and engaged with the front end of the spring 585, 685, 785, 885.

Figure 15:
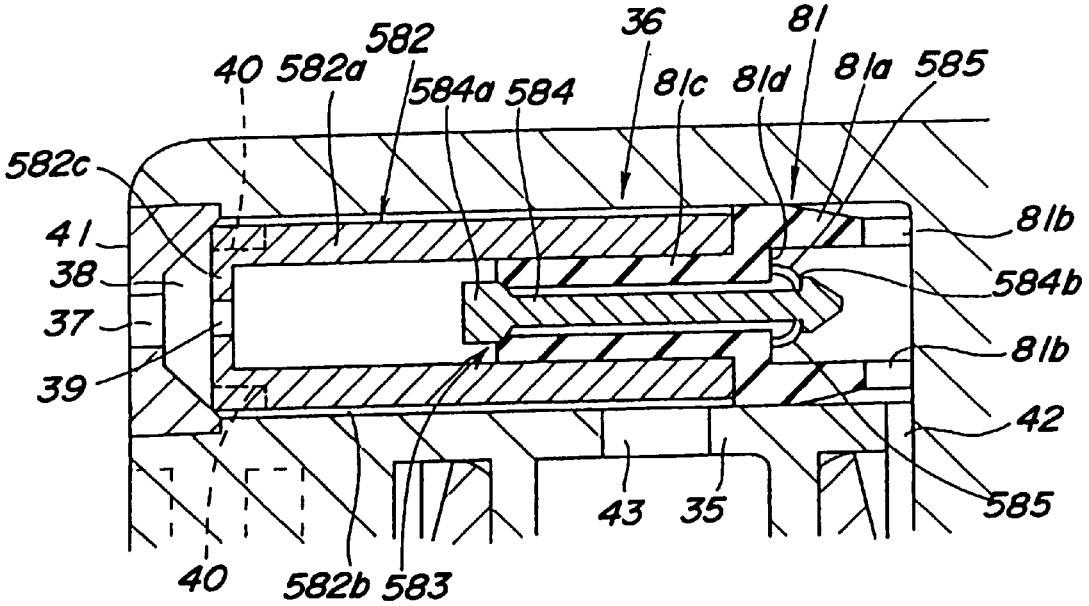

In the embodiment shown in FIG. 15, the front end portion 584*a* of the valve body 584 has a rear surface with a tapered periphery, and the rear end portion 584*b* of the valve body 584 arranged within the large diameter portion 81*a* of the first tubular member 81 has an increased diameter. Furthermore, the spring 585 is in the form of at least one leaf spring arranged between the annular shoulder portion 81*d* of the first tubular member 81 and an engaging step which is formed by the rear end portion 584*b* of the valve body 584. In this instance, there may be provided a plurality of leaf springs 585 which are spaced from each other in the circumferential direction.

Figure 16:
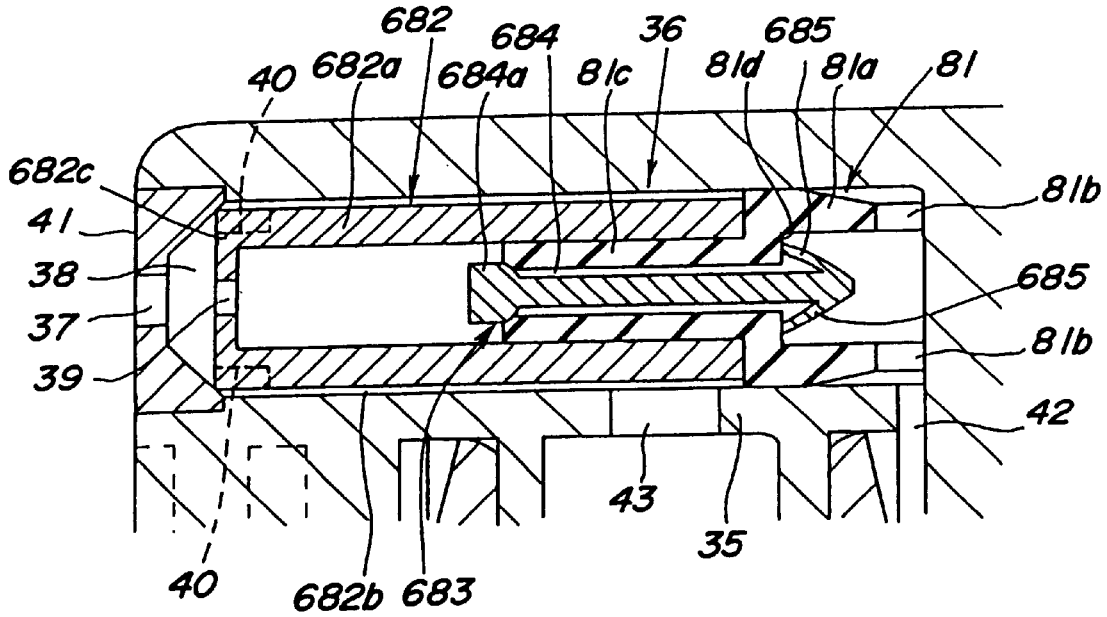

In the embodiment shown in FIG. 16 also, the valve body 684 arranged in the cylindrical portion 682*a* of the second tubular member 682 includes a front end portion 684*a* having a rear surface with a tapered periphery. The resilient body 685 for urging the valve body 684 rearwards is formed integrally with the rear end portion of the valve body 684 which is arranged in the large diameter portion 81*a* of the first tubular member 81. That is to say, a plurality of resilient projections 685 forming the resilient body are arranged so as to protrude obliquely forwards, from the rear end portion of the valve body, and the free end of each of resilient projection 685 is engaged with the annular shoulder 81*d* of the first tubular member 81.

Figure 17:
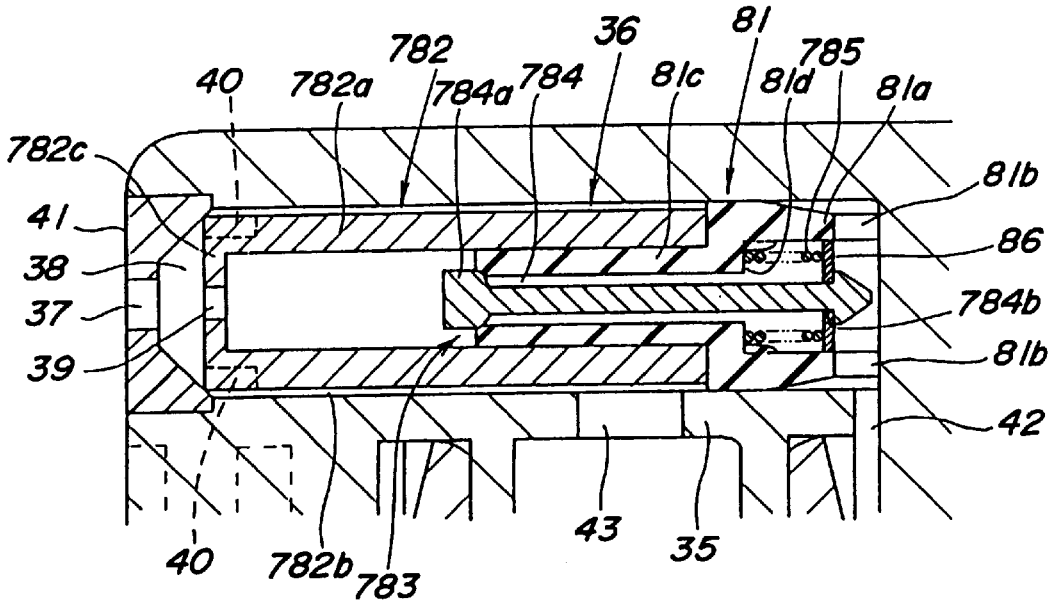

The embodiment shown in FIG. 17 provides a valve body 784 which is similar in shape to, but made somewhat longer than, the valve body in the embodiment of FIG. 15. The valve body 784 is urged rearwards, by a compression coil spring 785 which is arranged in the large diameter portion 81*a* of the first tubular member 81. An engaging disc 786 is fitted over the valve body 784, and the disc 786 is axially positioned by an engaging step which is formed by the ear end portion 784*b* of the valve body 784. The spring 785 is arranged between the engaging disc 786 and the annular shoulder 81*d* of the first tubular member 81.

Figure 18:
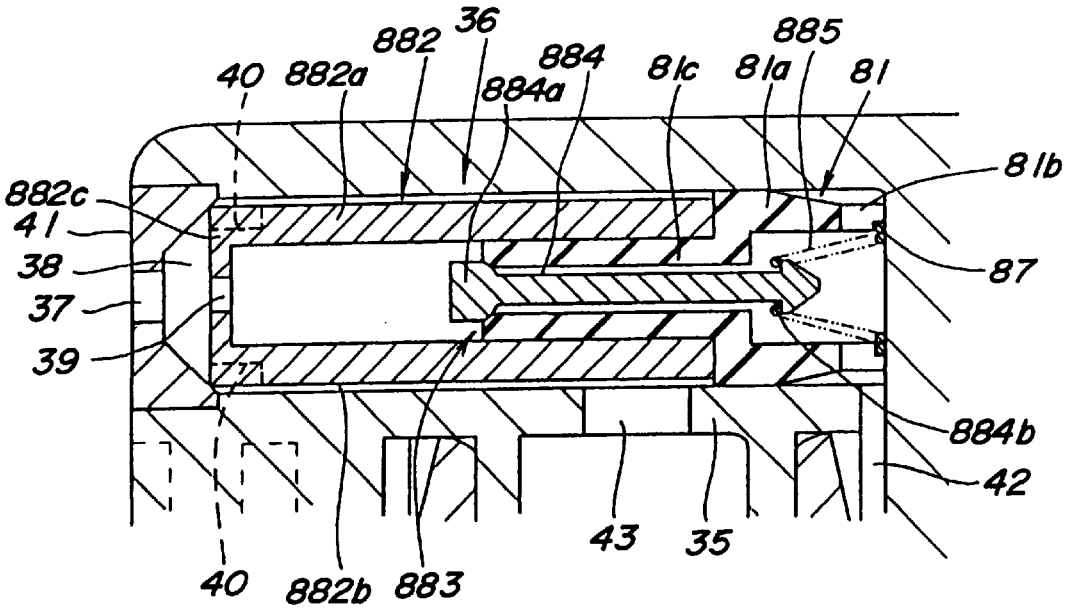

The embodiment shown in FIG. 18 provides a valve body 884 which is similar in shape to the valve body in the embodiment of FIG. 15, and a helical coil spring 885 which is arranged in the large diameter portion 81*a* of the first tubular member 81. The front end of the coil spring 885 is engaged with the engaging step which is formed by the rear end portion 884*b* of the valve body 884. The rear end of the coil spring 885 is engaged with an engaging recess 87 formed in the inner peripheral region at the rear end of the large diameter portion 81*a*.

Figure 19:
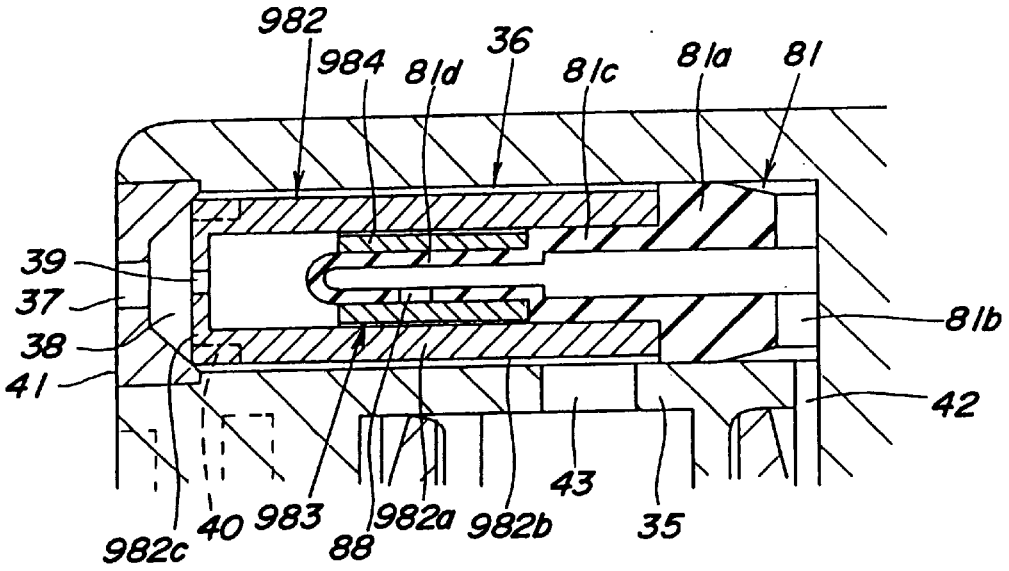

In the embodiment shown in FIG. 19, the first tubular member 81 of the inner tube 36 includes a front end portion 81*d* which is connected to the front end side of the small diameter portion 81*c*. The front end portion 81*d* is smaller in outer diameter than the small diameter portion 81*c*, and has a front end which is closed. At least one through hole 88 is formed in the side wall of the front end portion 81*d*, in its longitudinally intermediate region. The valve body of the relief valve 983 consists of a resilient tube 984 which is tightly fitted over the outer periphery of the front end portion 81*d*, and the resilient tube 984 is composed of flexible and resilient material, such as elastomer. The resilient tube 984 is normally in tight contact with the outer periphery of the front end portion 81*d* to close the through hole 88, and undergoes a resiliently inflating deformation to open the through hole 88 when the inner pressure of the first tubular member 81 increases, so as to bring the interior of the first tubular member 81 into communication with the interior of the second tubular member 982.

Figure 20:
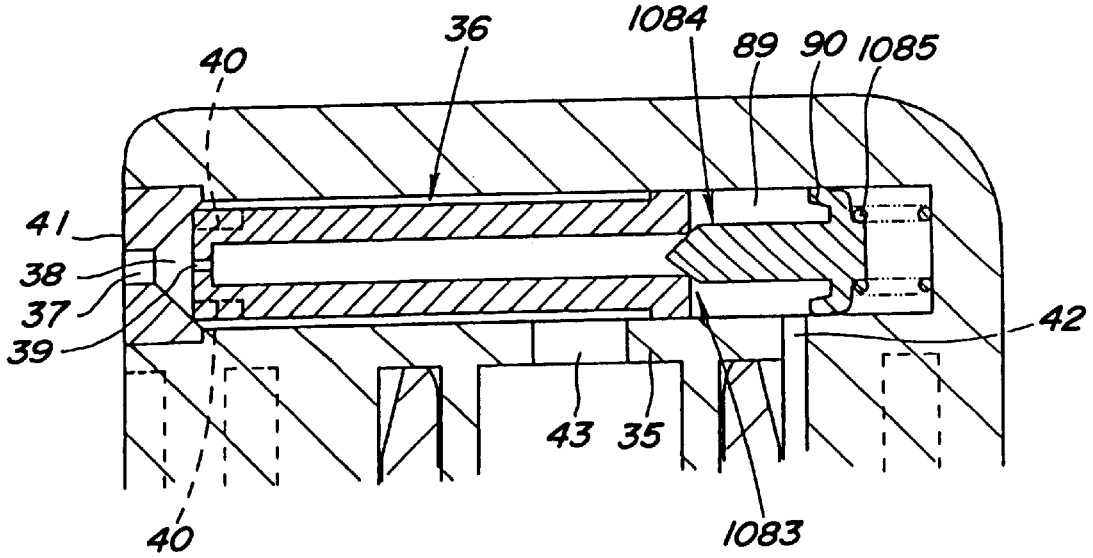

In the embodiment shown in FIG. 20, the inner tube 36 inserted into the transverse bore which extends from the side surface of the press head 26 inwards has a large diameter portion at its rear end which is tightly fitted in the transverse bore. A valve chamber 89 is arranged between the rear end of the inner tube 36 and the inner end of the transverse bore, and is communicated with the air passage 42. The valve body 1084 and the compression coil spring 1085 of the relief valve 1083 are arranged in the valve chamber 89. The valve body 1084 is normally urged by the spring 1085 to close the rear end of the inner tube 36 in air-tight manner. The rear end of the valve body 1084 is provided with an annular seal member 90 which slidably contacts with the inner wall of the valve body 89 in air-tight manner. When the inner pressure of the air passage 42 increases, the thrust arising from the inner pressure as applied to the annular seal member 90 of the valve body 1084 overcomes the urging force of the spring 1085 and forces the valve body 1084 rearwards against the spring 1085 to thereby open the ear end of the inner tube 36.

Figure 21:
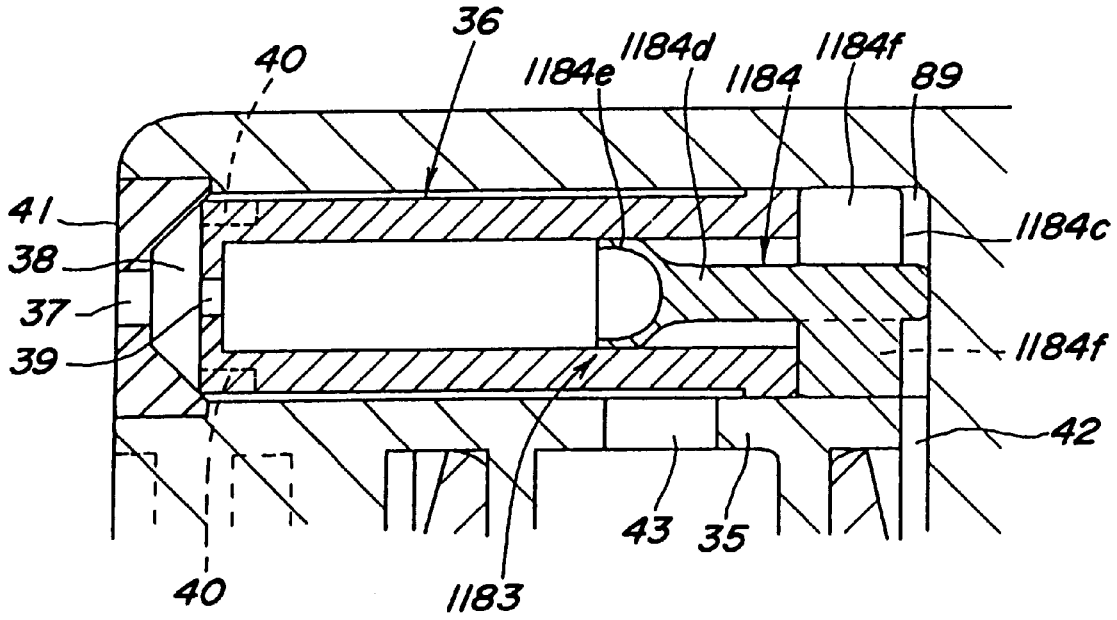

The embodiment shown in FIG. 21 is essentially the same as the embodiment of FIG. 20 in terms of the arrangement of the inner tube 36. In the present embodiment, the valve body 1184 of the relief valve 1183 is composed of rubber or the like resilient material, and includes a base portion 1184*c* which is fitted in, and fixedly secured to the valve chamber 89, a rod 1184*d* which protrudes from the center region at the front surface of the base portion 1184*c* into the inner tube 36, and a resilient skirt 1184*e* which is provided at the front end of the rod 1184*d*. The resilient skirt 1184*e* has an outer periphery which is normally in contact with the inner peripheral surface of the inner tube 36 in air-tight manner. The base portion 1184*c* is a cylindrical body which is fitted with the peripheral wall surface of the valve chamber 89. The base portion 1184*c* has a rear surface provided with a center projection which is engaged with the end wall of the transverse bore, and a plurality of radial cut grooves 1184*f* which extend from the center and which are communicated with the air passage 42. When the inner pressure of the air passage 42 increases, the outer periphery of the resilient skirt 1184*e* is spaced from the inner peripheral surface of the inner tube 36 so that the interior of the inner tube 36 is communicated with the air passage 42.

While the present invention has been described above with reference to preferred embodiments shown in the accompanying drawings, it is of course that the invention is not limited to such specific embodiments and various changes or modifications may be made without departing from the scope of the invention.

What is claimed is:

1. A manually operated spray device to be secured to an opening at an upper end of a vessel, for spraying a liquid contained in the vessel, comprising:

a cylinder member including an upper air cylinder, a lower liquid cylinder, an air piston slidably fitted in said air cylinder, and a suction pipe connected to said liquid cylinder and suspended within the vessel toward a bottom of the vessel;

an actuator member protruding upwards from said cylinder member and arranged so as to be urged upwards and vertically movable relative to the cylinder member;

said actuator member including a hollow stem having an intermediate portion where it is connected to the air piston, a press head fitted onto an upper portion of the stem, a nozzle hole opening at a side surface of the press head, and first and second passages merging with each other on an upstream side of the nozzle hole;

said first passage being in communication with an air chamber on one side of the air piston, and said second passage being in communication with the liquid cylinder through inside of the stem, said passages being so arranged that air within said air chamber is discharged from the nozzle hole, through said first passage, by depressing the actuator member toward the vessel, thereby applying a vacuum within inside of the second passage such that the liquid within said vessel is sucked through the second passage, mixed with air and discharged from the nozzle hole.

2. The spray device according to claim 1, wherein said actuator member includes a transverse bore within said press head, which extends in a radial direction substantially in alignment with the nozzle hole, and an inner tube arranged within said transverse bore, one of said first and second passages being formed by a passage which extends through inside of the inner tube to the nozzle hole, and the other of said first and second passages being formed by a passage which extends along an outer surface of the inner tube to said nozzle hole.

3. The spray device according to claim 1, wherein a liquid check valve is arranged in the upper portion of the stem.

4. The spray device according to claim 1, wherein a spinning mechanism in the form of volute channels is arranged at a downstream end of the first passage where it merges with the second passage.

5. A manually operated spray device to be secured to an opening at an upper end of a vessel, for spraying a liquid contained in the vessel, comprising:

a cylinder member including an upper air cylinder, a lower liquid cylinder, an air piston slidably fitted in said air cylinder, and a suction pipe connected to said liquid cylinder and suspended within the vessel toward a bottom of the vessel;

an actuator member protruding upwards from said cylinder member and arranged so as to be urged upwards and vertically movable relative to the cylinder member;

said actuator member including a hollow stem having an intermediate portion where it is connected to the air piston, a press head fitted onto an upper portion of the stem, a nozzle hole opening at a side surface of the press head, and first and second passages merging with each other on an upstream side of the nozzle hole;

said first passage being in communication with an air chamber on one side of the air piston, and said second passage being in communication with the liquid cylinder through inside of the stem, said passages being so arranged that air within said air chamber is discharged from the nozzle hole, through said first passage, by depressing the actuator member toward the vessel, thereby applying a vacuum within inside of the second passage such that the liquid within said vessel is mixed with air and discharged from the nozzle hole, wherein said press head of the actuator member includes a peripheral wall surrounding an upper portion of the stem, said air piston having a boss in its center portion, said boss being fitted onto in outer surface of the stem and having the outer surface at its upper portion, which is fitted, in a liquid-tight manner, with an inner surface of the peripheral wall at its lower portion, such that the boss can be moved vertically, relative to the peripheral wall, within a predetermined small stroke, said first passage being partly formed of a clearance between the inner surfaces of the peripheral wall and the boss and the outer surface of the stem, said stem having an intermediate portion which is provided with a seat having a upper surface with which a lower end surface of said boss can be brought into contact, said lower surface of the boss and the upper surface of the seat forming an air discharge valve.

6. The spray device according to claim 5, wherein said air piston comprises a wall having at least one valve hole between said boss and an outer peripheral portion thereof, which slidably contacts the inner surface of the air cylinder, and a seal means for normally shielding said valve hole from the air chamber and opening the valve hole relative to the air chamber when a negative pressure is applied to inside of the air chamber.

7. The spray device according to claim 5, wherein a frictional resistance of the inner surface of the boss relative to the outer surface of the stem is made smaller than a frictional resistance of an outer surface of the air piston relative to the inner surface of the air cylinder.

8. The spray device according to claim 6, wherein said seal means comprises an annular resilient sheet which is supported by the lower portion of the boss, said resilient sheet having an outer periphery which can be brought into contact, in air-tight manner, with the lower surface of said wall at a location which is on radially outer side of the valve hole.

9. A manually operated spray device to be secured to an opening at an upper end of a vessel, for spraying a liquid contained in the vessel, comprising:

a cylinder member including an upper air cylinder, a lower liquid cylinder, an air piston slidably fitted in said air cylinder, and a suction pipe connected to said liquid cylinder and suspended within the vessel toward a bottom of the vessel;

an actuator member protruding upwards from said cylinder member and arranged so as to be urged upwards and vertically movable relative to the cylinder member;

said actuator member including a hollow stem having an intermediate portion where it is connected to the air piston, a press head fitted onto an upper portion of the stem, a nozzle hole opening at a side surface of the press head, and first and second passages merging with each other on an upstream side of the nozzle hole;

said first passage being in communication with an air chamber on one side of the air piston, and said second passage being in communication with the liquid cylinder through inside of the stem, said passages being so arranged that air within said air chamber is discharged from the nozzle hole, through said first passage, by depressing the actuator member toward the vessel, thereby applying a vacuum within inside of the second passage such that the liquid within said vessel is mixed with air and discharged from the nozzle hole, wherein a normally closed relief valve is interposed into said first passage, said relief valve including a valve body which is resiliently urged toward a valve seat and which opens when a predetermined pressure level is reached.

10. The spray device according to claim 9, wherein said relief valve comprises a resilient element which urges the valve body toward the valve seat, said resilient element being arranged on an upstream side of the valve body.

11. The spray device according to claim 9, wherein said relief valve comprises a resilient element which urges the valve body toward the valve seat, said resilient element being arranged on a downstream side of the valve body.

12. The spray device according to claim 9, wherein said valve body is formed of a resilient material and urged toward the valve seat by a resiliency of the material itself.

* * * * *